United States Patent [19]

Hotta et al.

[11] Patent Number: 4,589,799

[45] Date of Patent: May 20, 1986

[54] DEVICE FOR LOCKING PLATFORM OF OFFSHORE STRUCTURE

[75] Inventors: Minoru Hotta, Yokohama; Okitada Hara, Tokyo; Toshimitsu Araki, Musashino, all of Japan

[73] Assignees: Ishikawajima-Harima Jukogyo Kabushiki Kaisha; The Shipbuilding Research Association, both of Tokyo, Japan

[21] Appl. No.: 540,554

[22] Filed: Oct. 11, 1983

[30] Foreign Application Priority Data

Oct. 26, 1982 [JP] Japan ..... 57-186733

[51] Int. Cl.[4] ..... E02B 17/06

[52] U.S. Cl. ..... 405/196; 254/105; 405/198

[58] Field of Search ..... 405/196, 198, 199; 254/95, 105

[56] References Cited

U.S. PATENT DOCUMENTS

| | | | |
|---|---|---|---|
| 2,540,679 | 2/1951 | Laffaille | 405/198 X |
| 4,255,069 | 3/1981 | Yielding | 405/196 |
| 4,269,543 | 5/1981 | Goldman et al. | 405/198 |
| 4,431,343 | 2/1984 | Uchiyama et al. | 405/198 |

*Primary Examiner*—David H. Corbin

[57] ABSTRACT

A device for locking a platform of an offshore structure wherein each of legs vertically rest on the sea floor and is provided with a rack. The platform in adapted to move upward or downward along the legs and is provided with chocks which engage with the racks, respectively, of the legs. The teeth of the chock has a whole depth deeper than that of the teeth of the rack so that when the chock engages with the rack, the deddendums of the chock is caused to deflect themselves respectively about the deddendums, which are made into engagement with the rack, so as to follow the displacement of the platform in the direction of gravity.

2 Claims, 13 Drawing Figures

DEVICE FOR LOCKING PLATFORM OF OFFSHORE STRUCTURE

BACKGROUND OF THE INVENTION

The present invention relates to a device for locking a platform of an offshore structure so that the platform may securely rest on supporting legs.

In order to tap submarine oil reservoirs or to accomplish various offshore operations, an offshore structure 1 called jacked-up rig as shown in FIG. 1 is used. The jacked-up rig 1 comprises a plurality of upright or vertical legs 3 resting on the sea floor 2 or the like and a platform 4 resting on the legs 3 and capable of being jacked up. Utilities and a living quarter are installed on the platform 4.

In operation, the rig 1 has its platform 4 securely rested on the legs 3 while when the height of the platform 4 above the sea level is varied or when the rig 1 is floated and towed, the platform 4 is lifted or lowered in the longitudinal direction (that is, in the vertical direction) of the legs 3. As shown in FIG. 2, a rack 5 disposed in the lengthwise direction of the leg 3 is in mesh with a pinion 6 disposed on the side of the platform 4 so that as the pinion 6 rotates, the platform 4 is raised or lowered relative to the legs 3.

In operation, the rig 1 is subjected to various external forces such as forces of waves, winds and currents so that the platform 4 must rest on the legs 3 as securely as possible. To this end, in addition to the above-described rack-and-pinion type jack, the rig 1 is provided with a locking device for securely supporting the platform 4 upon the legs 3.

One of the conventional locking devices is shown in FIG. 2. The platform 4 is provided with a chock 7 which is adapted to engage with the rack 5 on the side of the leg 3. The engagement between the chock 7 and the rack 5 can support the weight of the platform 4 and withstand the external forces such as the forces of waves, winds and currents. The chock 7 can be raised or lowered by means of two wedges 9 with their inclined surfaces 8 in contact with upper and lower surfaces of the chock 7. An actuator 10 is securely joined to a rear surface 7*a* of the chock 7 for the movement of chock 7 toward or away from the rack 5.

In order to engage the platform 4 with the legs 3, the pinion 6 is driven until the platform 4 reaches a predetermined height. Thereafter, drive means (not shown) is energized to horizontally slide the wedges 9 in opposite directions, whereby the chock 7 is raised or lowered for alignment of the teeth. Next the actuator 10 is energized to engage the chock 7 with the rack 5. Under these conditions, the wedges 9 are displaced toward the rack 5 and the pinion 6 is released so that it may freely rotate. Thus, the platform 4 can rest on the legs 3 as the load of the platform 4 is supported by the teeth of the chock 7 and rack 5 which are engaged with each other.

In the conventional locking device as described above, as shown in FIGS. 3A, 3B and 3C, the teeth 11 of the rack 5 and the teeth 12 of the chock 7 have the same configuration so that they may mesh very closely. These teeth 11 and 12 are not produced by machining, but are formed by a gas cutting process or the like so that they tend to have pitch errors. When the rack 5 and the chock 7 are engaged with each other so that the platform 4 may be supported by the legs 3, the weight of the platform 4 and the external forces such as forces of winds, waves and currents are exerted to the teeth 11 and 12. As a result, the teeth 11 and 12 are forcedly deflected. According to the experiences, it has been known that the deflection is substantially equal to the pitch error. This will be described in more detail below. As shown in FIGS. 3A through 3C, the fact that the platform 4 is supported by the legs 3 means that the teeth 12 of the chock 7 are supported by the teeth 11 of the rack 5. As a result, both the teeth 11 and the teeth 12 are deflected. As shown in FIG. 3A, even when all the teeth 11 and 12 have exactly a predetermined pitch P, all the load of the platform 4 cannot be uniformly distributed to the teeth 1 of the rack 5. There is a tendency that the load is concentrated on the uppermost and lowermost engaged teeth 11 of the rack 5. If the pitch of some tooth 11 of the rack 5 is greater than a predetermined pitch P and for example is $(P+P_1)$ as shown in FIG. 3B, said tooth 11 and the corresponding tooth 12 are spaced by a very small distance as if they were in abutment with each other. Then, a higher load is exerted to said teeth 11 and 12 so that the deflection $\delta_L$ occurs. On the other hand, if the pitch of some tooth 11 of the rack 5 is smaller than a predetermined pitch P and for example is $(P - P_2)$ as shown in FIG. 3C, no load is exerted to said tooth 11 and the corresponding tooth 12 which are spaced apart from each other by a distance equal to or greater than the deflection $\delta$ to be expected in the engagement of the teeth with no pitch error.

It is considered that when the teeth of the chock and the rack have the same configuration, they are subjected to load concentration (as shown in FIG. 3B) or no load is exerted to the teeth 11 and 12 (as shown in FIG. 3C). Such loading conditions are not satisfactory from the viewpoint of mechanical strength. In order to overcome these problem, it may be proposed to increase the size of the teeth and hence their strength, but the legs 3 and the chocks 7 will then become heavy in weight and expensive. Thus, such proposal is not satisfactory.

The present invention was made to overcome the above and other problems encountered in the conventional devices for locking a platform of an offshore structure and has for its object to provide an improved device for locking a platform of an offshore structure in which each of the teeth of racks and chocks can uniformly bear the load of the platform and external forces such as waves, winds and currents, whereby the mechanical strength and safety of the locking device may be improved.

The above and other objects, effects and features of the present invention will become more apparent from the following description of a preferred embodiment thereof taken in conjunction with the accompanying drawings.

DESCRIPTION OF THE PREFERRED EMBODIMENT

Figure 6:
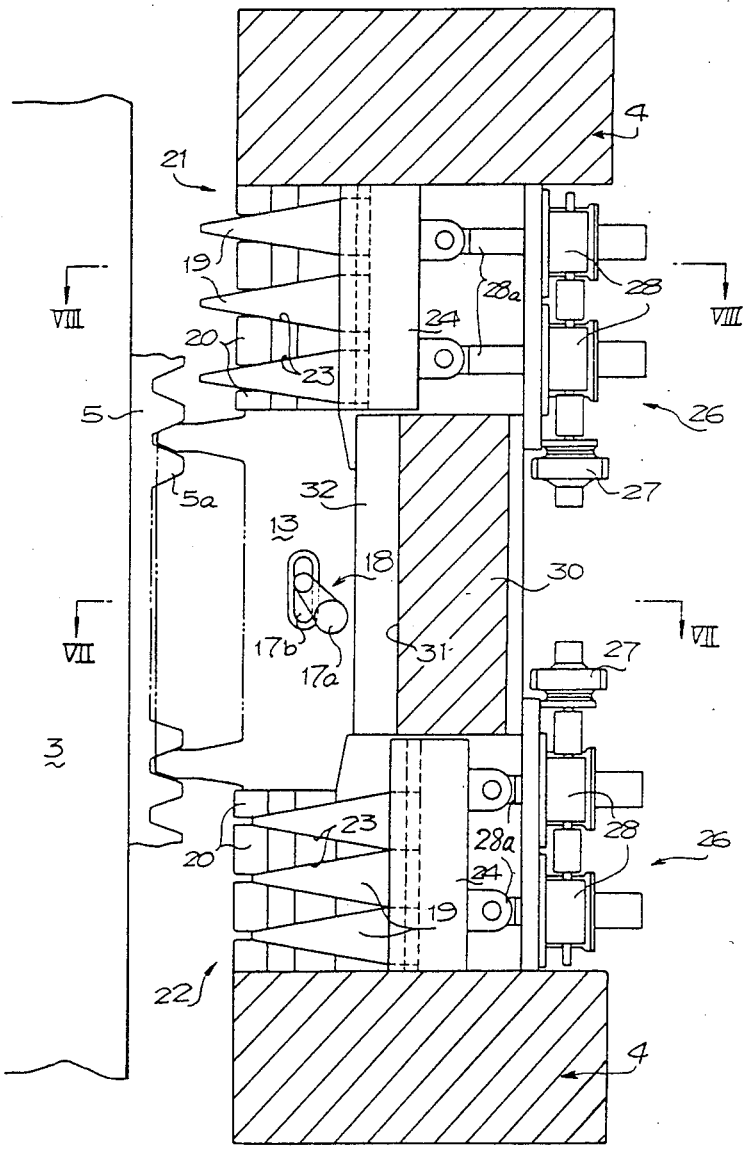
FIG. 6 is a fragmentally sectional view of an offshore platform with a locking device in accordance with the present invention.

Referring first to FIG. 6, a leg 3 which vertically rests on the sea floor or the like has a rack 5 extending in the longitudinal direction of the leg 3. A platform 4 is adapted to be raised or lowered relative to the leg 3 by a pinion (not shown) which is in mesh with the rack 5. The platform 4 is raised or lowered relative to the leg 3 in a manner substantially similar to that described before and the present invention is characterized by a device for locking the platform 4 to the legs 3.

Figure 4:
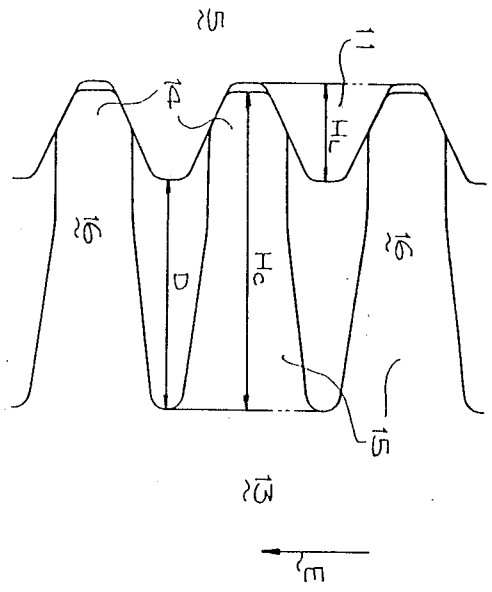
FIG. 4 is a schematic side view of a preferred embodiment of the present invention.
Figure 9:
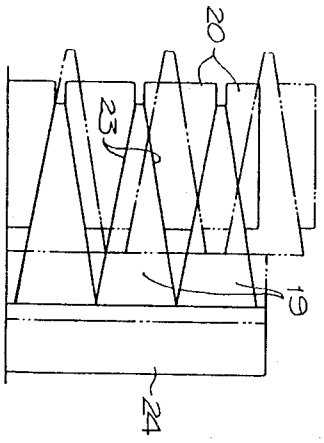
FIG. 9 is a view used for explanation of the mode of operation of a wedge assembly in accordance with the present invention.

The platform 4 is provided with a chock 13 adapted to engage with the rack 5 so that the platform 4 may be supported by the legs 3. As best shown in FIG. 4, the chock 13 engages with the rack 5. The chock 13 has a great or deep clearance D relative to the rack 5 so that the deddendum 15 is deflected about the addendum 14 in the direction of the weight of the platform 4 (indicated by the arrow E). That is, as described before, the chock 13 is locked by means of wedge members so as to be integral with the platform 4 and the weight of the platform 4 and the vertical components of the external forces such as the forces of waves, winds and currents are trasmitted through the teeth 11 of the rack 5 to the leg 3, whereby the platform 4 is supported by the legs 3. In the conventional locking devices, the load is directly transmitted between the teeth 11 of the rack 5 and the teeth 16 of the chock 13 so that the teeth 11 and 16 are forced to be deflected; but according to the present invention, the deddendum 15, which is located adjacent to the platform 4 which tends to displace itself in the direction of gravity due to its weight and the external forces exerted thereto, is forced to be deflected positively about the addendum 14 in mesh with the rack 15 in such a way that the deflection of each tooth 16 is sufficiently greater than a pitch error.

According to the extensive studies and experiments conducted by the inventors, it is found out that if the whole depth HC of the teeth 16 of the chock 13 is greater than 1.5 times as deep as the whole depth $H_L$ of the teeth 11 of the rack 5, the deflection becomes satisfactorily greater than a pitch error.

According to the present invention, the tooth 16 of the chock 13 is in the form of the so-called "beam of equal strength" (that is, a beam in which the surface stress is uniform over the whole length of the beam). Therefore, as compared with the conventional teeth, the tooth 16 is made of a minimum quantity of material, has a high degree of strength and is capable of deflecting itself sufficiently. Furthermore, in order to relax stress concentration due to the deflection of the adjacent teeth 16, the deddendums 15 are defined by merging arcs.

Figure 3A:
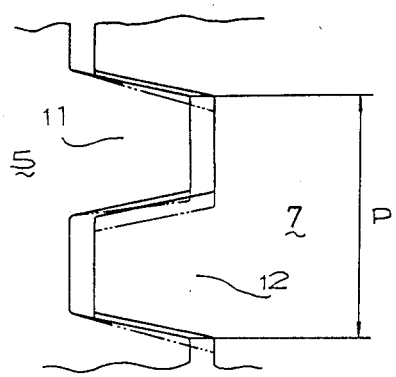
Fig.3A PRIOR ART
FIGS. 3A, 3B and 3C views used for explanation of engagement between the teeth of a chock and rack in a conventional locking device.
Figure 3B:
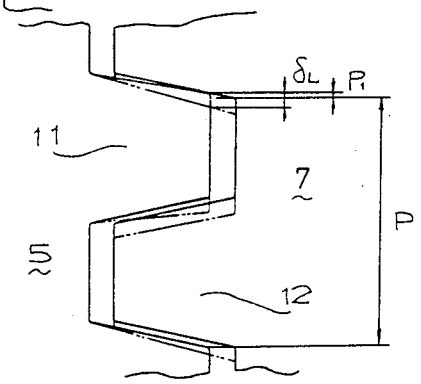
Fig.3B PRIOR ART
Figure 3C:
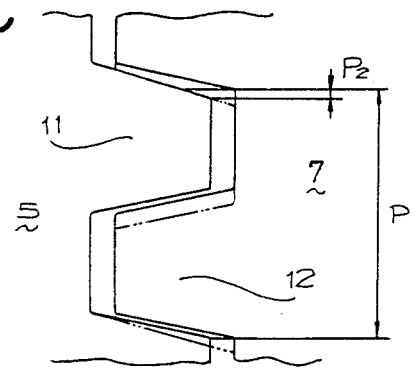
Fig.3C PRIOR ART
Figure 5A:
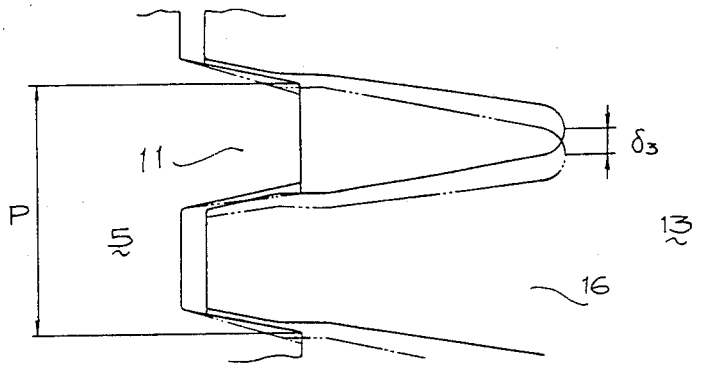
FIGS. 5A, 5B and 5C are views used for explanation of engagement between the teeth of a chock and rack in accordance with the present invention.
Figure 5B:
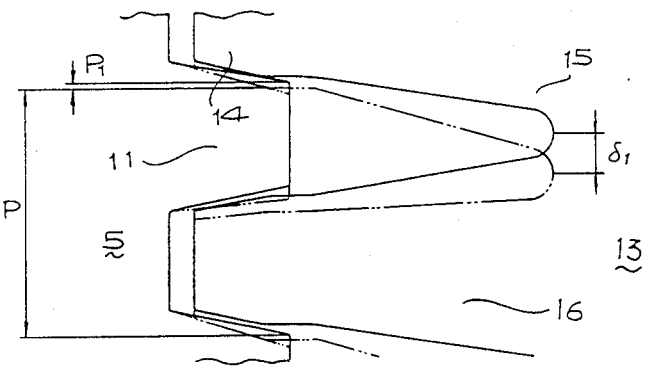
Figure 5C:
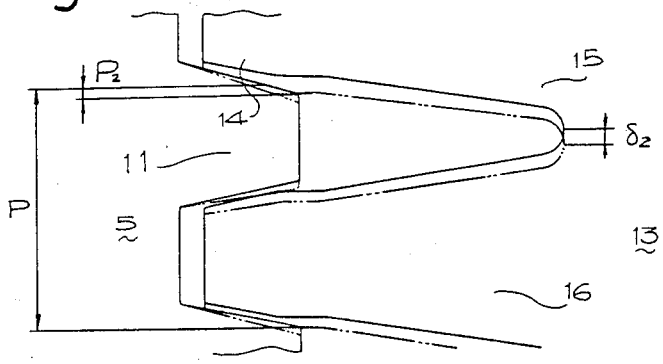

FIGS. 5A, 5B and 5C show the engagement of the chock 13 in accordance with the present invention with the rack 5 similar to those as shown in FIGS. 3A, 3B and 3C. When the pinion is released and a load is exerted between the teeth 11 of the rack 5 and the teeth 16 of the chock 13, load components of different magunitudes are ready to be exerted on the teeth 11 and 16 due to a pitch error. If, as shown in FIG. 5B, the pitch of some tooth 11 is greater than a predetermined pitch P and for example is $(P+P_1)$ as shown so that said tooth 11 and the corresponding tooth 16 are so spaced apart from each other that they are alomost in abutment with each other, great load components are ready to be exerted on the specific teeth 11 and 16. However, the tooth 16 of the chock 13 has a sufficient degree of flexibility and is adapted to greatly deflect ($\delta_1$ in FIG. 5B) the deddendum 15 is disposed about the addendum 14 in the downward direction. As a result, the adjacent teeth 16 are deflected downwardly so that the load may be dipersed thereto, so that it can be avoided that great load components are applied to the specific teeth 11 and 16. That is, uniform load distribution can be attained. If, as shown in FIG. 5C, the pitch of some tooth 11 is smaller than a predetermined pitch P and for example is $(P - P_2)$ as shown so that said tooth 11 and the corresponding tooth 16 are spaced apart from each other by a relatively great distance, the tooth 16 of the chock 13 is caused to be displaced ($\delta_2$ in FIG. 5C) about the addendum 14 of the tooth 16 by a degree greater than the pitch error in the direction of the gravity. As a result, the pitch error $P_2$ is compensated and the specific teeth 11 and 16 can support the load. The load can be dispersed to all of the teeth 11 and 16 so that the uniform load distribution can be obtained.

If all the teeth 11 and 16 have a predetermined pitch P as shown in FIG. 5A and have no pitch error, the whole load is substantially uniformly dispersed to all of the teeth 11 and 16 and each tooth 16 is deflected by $\delta_3$ so that the platform 4 can be securely supported by the legs 3.

As described above, according to the present invention, the clearance D of the chock 13 relative to the rack 5 is made deep as shown in FIG. 4 and the chock 13 in engagement with the rack 5 has its deddendum 15 displaced about the addendum 14 in the direction of the gravity of the platform 4 (that is, in the direction indicated by the arrow E). Therefore, regardless whether there exists a pitch error or not, the load is substantially uniformly distributed and exerted to all of the teeth so that they can satisfactorily withstand the external forces such as the forces of waves, winds and currents. Thus, the structural strength and safety can be improved.

Furthermore, the load can be substantially uniformly distributed over all of the teeth so that the number of teeth can be reduced to a minimum. As a result, the weights of the leg 3 and the chock 13 can be reduced.

According to the present invention, each of the teeth 16 of the chock 13 is in the form of "a beam with uniform strength" so that even though each tooth 16 is made of a minimum weight of material, it can be satisfactorily deflected and have a high degree of strength. Thus, in view of the structural strength and cost, the present invention is very advantageous.

Figure 1:
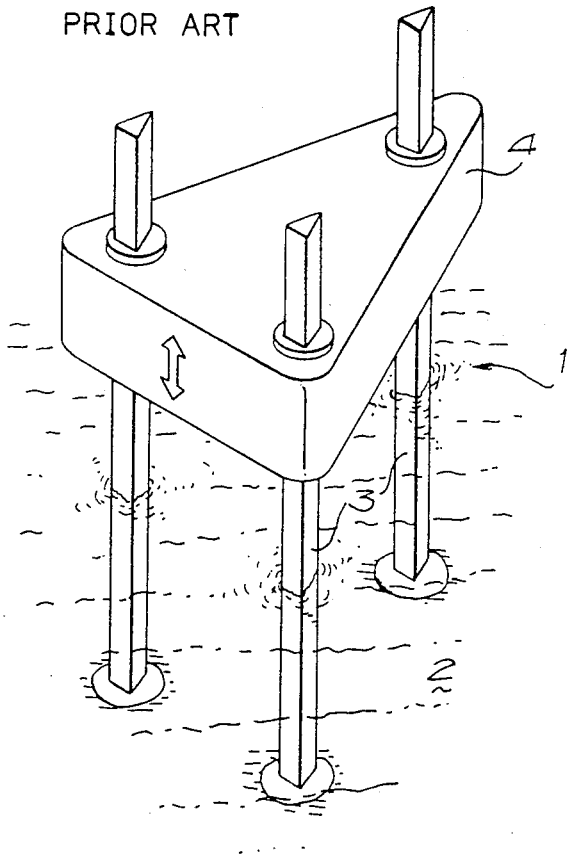
Fig.1 PRIOR ART
FIG. 1 is a perspective view of a conventional offshore platform or structure.
Figure 2:
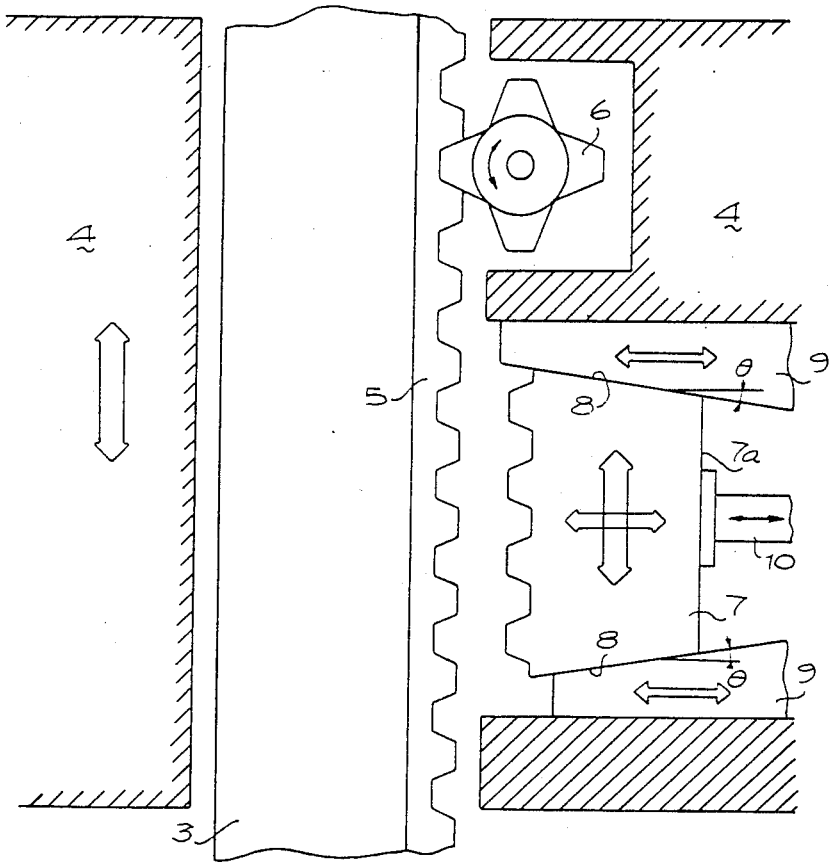
Fig.2 PRIOR ART
FIG. 2 is a fragmentary sectional view, on enlarged scale, thereof.

Next the locking device with the chock 13 will be described in detail. As shown in FIG. 2, in consideration of the holding force of drive means which drives the wedge members 9 and locks them and of the horizontal components of great loads such as the forces of waves, winds and currents which are exerted to the offshore structure when the platform 4 is securely held in position, the slope of the inclined surface 8 of each wedge member 9 is made relatively gentle. That is, when the slope of the inclined surface 8 of the wedge member 9 is gentle, the horizontal component of the force acting through the inclined surface 8 onto the drive means can be decreased and a small holding force or pressure can produce a great locking force. The vertical displacement of the chock 7 caused when the wedge members 9 are displaced is dependent upon the angle of inclination $\theta$ of the inclined surface 8 of the wedge member 9. Therefore in order that the chock 7 may be so displaced that the teeth 16 of the chock 7 may be aligned with the teeth 11 of the rack 5, the wedge members 9 must be large in size so as to have a long inclined surface 8. Thus, it has been impossible to make the locking device compact in size.

The present invention provides a device for locking a platform of an offshore structure which can be made satisfactorily compact in size, can attain a sufficient locking force and can ensure the satisfactory operation of the above-described chock 13.

Figure 7:
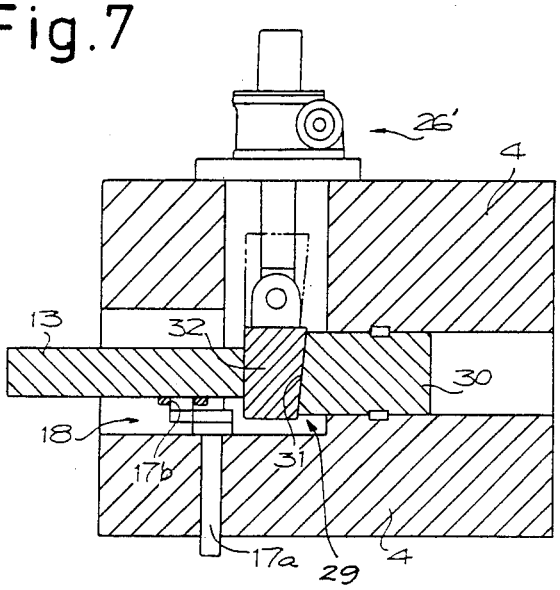
FIG. 7 is a sectional view taken along the line VII—VII in FIG. 6.
Figure 8:
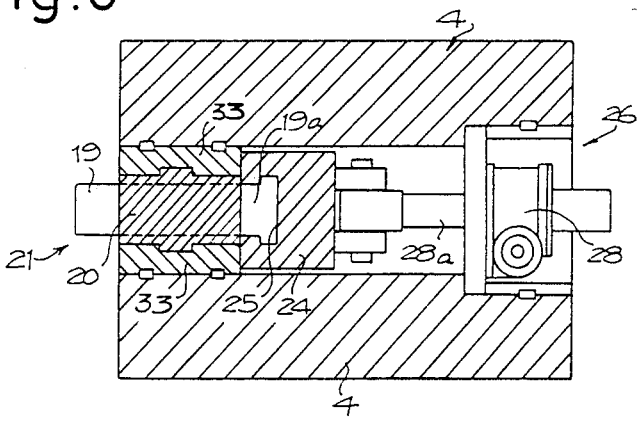
FIG. 8 is a sectional view taken along the line VIII—VIII in FIG. 6.

Referring back to FIG. 6, within the platform 4 there is provided the chock 13 for engagement and in opposed relationship with the rack 5 of the leg 3 which supports the platform 4. By means of chock advancing means 18 operatively interconnected between a shaft 17*a* journaled by the platform 4 and a guide groove 17*b* of the chock 13 as shown in FIGS. 6 and 7, the chock 13 is moved toward or away from the engaging portions or teeth 5*a* of the rack 5. Above and below the chock 13 are disposed a plurality of wedge members 19 and 20 which are interleaved with eacn other and which are adapted to support, raise or lower and lock the platform 4. A plurality of wedge members 19 and 20 above the chock 13 are referred to as "an upper wedge assembly 21" while a plurality of interleaved wedge members 19 and 20 below the chock 13 are referred to as "a lower wedge assembly 22". The wedge members 19 and 20 are so interleaved that the wedge members 19 slide along inclined planes 23 over the mating wedge members 20 while the wedge members 20 slide along the inclined planes 23 over the mating wedge members 19. As shown in FIGS. 6 and 8, each of the wedge members 20 on the side of the leg 3 is fitted between guide rails 33 which are mounted on the platform 4 so that it is slidable only in the vertical direction. The wedge members 19 on the side of the platform 4 mate along the inclined planes 23 with those of the adjacent wedge members 20. Each of the wedge members 19 has an enlarged end portion 19*a* which is slidably fitted into a guide groove 25 of a pushing member 24 to be described below so that the wedge member 19 may slide only in the vertical direction. The pusing member 24 with the guide groove 25 is reciprocably disposed along the platform 4 so as to be slidable in the horizontal direction. Therefore each wedge member 19 is slidable along the inclined planes 23 over the adjacent wedge members 20. It follows therefore that when the pushing member 24 is reciprocated, the length of engagement between the adjacent wedge members 19 and 20 becomes longer or shorter so tnat the overall thickness of the upper wedge assembly 21 may be continuously varied. The feature of the upper wedge assembly 21 resides in the fact that it comprises a plurality of short wedge members which are interleaved so that a plurality of inclined planes 23 may be defined. As a result, the upper wedge assembly 21 can be raised or lowered by a sufficinet height when the pushing member 24 is driven only by a short stroke. In the preferred embodiment, six inclined planes 23 are provided so that, as compared with a single wedge member with the same angle of inclination, a sixth (1/6) stroke will do so as to raise or lower the upper wedge assembly 21 by the same height.

In order to reciprocate the pushing member 24, there is provided a wedge control means 26 comprising a drive source such as a hydraulic motor 27, a worm driven by the drive source 27 and a drive member 28 such as a screw jack which is in mesh with the worm so as to be reciprocated. The output end 28*a* of the drive member 28 is joined to the pushing member 24. The wedge control means 26 drives the upper wedge assembly 21 through the pushing member 24 so that the wedges 19 and 20 slide with each other to vary the height of the upper wedge assembly 21 for alignment of the teeth. In this way the chock 13 is raised or lowered along the rack 5 of the leg 3 while the chock 13 is advanced by the chock advancing means 18. Thereafter the chock 13 and the rack 5 are engaged with each other and locked by means of a rear wedge body 29 to be described below and then the wedge members 19 and 20 are caused to engage with each other deeply (that is, the wedge members 19 and 20 are so engaged with each other that the length of engagement between them becomes longer), whereby the chock 13 and the rack 5 are locked firmly with each other.

The same is true for the lower wedge assembly 22, but it should be noted that when the chock 13 is raised or lowered, the lower wedge assembly 22 is moved in the direction opposite to the direction in which the upper wedge assembly 21 is moved.

The rear wedge body 29 is disposed adjacent to the rear portion of the chock 13 so as to effect the locking operation after the rack 5 and the chock 13 are aligned in their teeth with each other by the wedge control means 26 and engaged with each other by the chock advancing means 18. As shown in FIGS. 6 and 8, the rear wedge body 29 comprises a stationary frame 30 securely attached to the platform 4 and a wedge member 32 whose inclined surface 31 mates with the inclined surface of the stationary frame 30. The surface opposite to the inclined surface 31 of the wedge member 32 abuts against the chock 13. By means of a wedge adjusting means 26' which is substantially similar in construction and operation to the wedge control means 26, the wedge member 32 slides along the inclined surface of the stationary frame 30 so that the chock 13 is locked in a manner substantially similar to that described before.

Next the mode of operation of the embodiment with the above described construction will be described. After the platform 4 has been raised or lowered by a predetermined height, it is locked to the legs 3. To this end, after the pinion which is in mesh with the rack 5 has been locked, the following operations are carried out.

When the pinion is locked, the chock 13 is still retracted within the platform 4. In this case, it does not follow that the tooth crests of the teeth of the chock 13 are in opposed relationship with the bottom lands or spaces of the teeth of the rack 5. Therefore, by means of the wedge control means 26, the pushing members 24 push or pull the upper and lower wedge assemblies 21 and 22 so that the wedge members 19 and 20 caused to slide relative to each other along the inclined planes 23, whereby the chock 13 is raised or lowered so as to align the teeth 16 of the chock 13 with the teeth 11 of the rack 5. That is, the chock 13 is raised or lowered so that the teeth 16 of the chock 13 may engage with the teeth 11 of the rack 5. In this case, each of the upper and lower edge assemblies 21 and 22 comprises a plurality of wedge members 19 and 20 which are interleaved as described before. Therefore, the upper and lower wedge assemblies 21 and 22 define many inclined planes 23 so that even when the pushing member 24 is displaced by a short stroke, the chock 13 is raised or lowered by a sufficient height as described bofore.

After the teeth 16 of the chock 13 has been correctly aligned with the teeth 11 of the rack 5 for engagement, the chock advancing means 18 is energized to push the chock 13 toward the rack 5 and consequently the teeth 16 of the chock 13 engage with the teeth 11 of the rack 5. After the engagement between the teeth 11 and 16 (that is, after the chock 13 is supported by the rack 5), the upper and lower wedge assemblies 21 and 22 are retracted and the wedge body 32 is fitted into the space between the chock 13, which has been advanced, and the stationary frame 30, whereby the chock 13 and the rack 5 are locked to each other under a high pressure. Thereafter, each of the upper and lower wedge assemblies 21 and 22 is advanced into a predetermined space defined between the platform 4 and the chock 13 so that the wedge effect can be attained. Thereafter the chock 13 and the rack 5 are locked to each other under a high pressure. Finally, the pinion is released so that it is permitted to freely rotate. Thus, the weight of the platform 4 and the external forces such as the forces of waves, winds and currents are transmitted through the chock 13 to the rack 5, whereby the platform 4 may be securely supported by the legs 3.

The reason why, after the engagement between the chock 13 and the rack 5, the upper and lower wedge assemblies 21 and 22 are retracted, then the wedge body 32 is inserted and thereafter the upper and lower wedge assemblies 21 and 22 are advanced will be described. If the teeth 16 of the chock 13 are misaligned with the teeth 11 of the rack 5, these teeth 16 and 11 cannot engage satisfactorily with each other by the engaging force produced by the chock advancing means 18. If the wedge body 32 is advanced under these conditions, the teeth 11 of the rack 5 and the teeth 16 of the chock 13 are deflected by an amount equal to the pitch error between the teeth 16 and the teeth 11. As a result, undesired forces are produced. To overcome this problem, the upper and lower wedge assemblies 21 and 22 are retracted so that the chock 13 may be moved vertically. Thereafter the wedge body 32 is advanced so that the chock 13 is caused to be displaced upwardly or downwardly by an amount equal to a pitch error or difference. As a result, the chock 13 is securely engaged with the rack 5. Thereafter, the upper and lower wedge assemblies 21 and 22 are advanced so that the chock 13 is securely held in position and immovable in the vertical direction.

According to the present invention, in order to raise or lower the chock 13, a large number of wedge members 19 and 20 are interleaved to provide many gently inclined planes 23. As a result, in response to the movement of the wedge assemblies only by short stroke, the sufficient and variable vertical movement of the chock can be obtained. Therefore, the inclined planes 23 can be reduced in length to a minimum so that the wedge assemblies can be made compact in size.

The wedge control means 26 can easily drive and lock the wedge members 19 and 20 since the latter have a satisfactory wedge effect because of many gently inclined planes 23. That is, when the wedge control means 26 drives the wedge members, a relatively low force can be used to cause the chock 13 to easily move upward or downward. When the wedge members are locked, the horizontal components of the weight of the platform 4 and the external forces such as the forces of waves, winds and currents can be reduced to a minimum by the inclined planes 23 so that a sufficiently high locking force can be obtained by a relatively low holding force. Thus, the wedge control means 26 can be made compact in size.

Therefore, the whole locking device can be very compact in size and a sufficiently high locking force can be produced.

Furthermore, if the wedge members are increased in number and are interleaved with the angle of the inclined plan being made small, self-locking can be attained by the frictional forces between the wedge members so that the holding force produced by the wedge control means 26 can be reduced to a minimum.

So far the wedge body 29 has been described as having only one wedge body 32, but if a desired stroke is long, the wedge body 29 may be constructed in a manner substantially similar to that described above with reference to the wedge assemblies 21 and 22.

The effects, features and advantages of the present invention may be summarized as follows:

(1) The clearance of the chock relative to the rack is made deep and the deddendum is caused to be displaced about the addendum, which is made into engagement with the rack, so as to follow the displacement of the platform in the direction of gravity (the load in the direction of gravity), whereby the teeth of the chock may be deflected greatly and positively. Therefore, regardless of a pitch error, the load may be uniformly distributed over all of the teeth.

(2) As a result, the legs can sufficiently receive the weight of the platform and the external forces such as the forces of waves, winds and currents without causing damage to the rack, and the structural strength and safety can be considerably improved.

(3) Because the load is substantially uniformly distributed over all the teeth, the number and rigidity of teeth can be reduced to minimum so that the legs and chocks can be made light in weight.

(4) Each wedge assembly comprises a plurality of wedge member which are interleaved with each other along gently inclined planes. Therefore, in response to the movement of the wedge assemblies by short stroke, the sufficient and variable upward or downward movement of the chock can be ensured. As a result, the wcdge assembly can be made compact in size.

(5) Many gently inclined planes assures a great wedge effect so that the chock can be raised or lowered by a small pushing force and the external forces can be sustained by a small holding force. Thus, the wedge control means can be made compact in size.

(6) Therefore, the whole locking device can be very compact in size and a sufficiently high locking force can be produced.

What is claimed is:

1. In an offshore structure having a plurality of legs to be erected substantially upright on a sea floor or the like, a plurality of racks respectively extending longitudinally of said plurality of legs and each having a plurality of first teeth, and a platform movable vertically relative to said plurality of legs: a device for locking said platform relative to said legs, said device comprising: a plurality of chocks each having a plurality of second teeth, each second tooth having an addendum remote from said chock for meshing engagement with the respective first tooth and a dedendum at said chock and free of the respective first tooth, the depth of each second tooth being greater than about 1.5 times the depth of each first tooth, whereby upon engagement of said first and second teeth the dedendums are deflected upon the addendums so as to follow displacement of said platform in the direction of gravity.

2. The combination of claim 1, comprising a plurality of wedge members having inclined surface cooperating with corresponding inclined surfaces of said plurality of chocks, and control means for sliding said wedge members relative to said chocks for moving said chocks relative to said rack to thereby align said second teeth relative to said first teeth prior to engagement.

* * * * *